US005361241A

United States Patent [19]

Ferrara et al.

[11] Patent Number: 5,361,241

[45] Date of Patent: Nov. 1, 1994

[54] VIB-A-WAKE

[76] Inventors: Salvator Ferrara, 20-04 Clintonville St., Whitestone, N.Y. 11357; Michael Sferrazza, 67-84 150th St., Flushing, N.Y. 11367; Pietro Oppedisano, 7-32 A Point Crescent, Whitestone, N.Y. 11357

[21] Appl. No.: 45,723

[22] Filed: Apr. 14, 1993

[51] Int. Cl.[5] ..... G04B 37/00

[52] U.S. Cl. ..... 368/281; 368/282; 368/230

[58] Field of Search ..... 368/281, 282

[56] References Cited

U.S. PATENT DOCUMENTS

| | | | |
|---|---|---|---|
| 4,130,987 | 12/1978 | Schickedanz | 368/282 |
| 4,427,303 | 1/1984 | Matthias | 368/282 |
| 4,862,436 | 8/1989 | Harilela | 368/282 |
| 5,020,039 | 5/1991 | Yokote | 368/282 |
| 5,072,429 | 12/1991 | Mair | 368/10 |
| 5,179,733 | 1/1993 | Matsui | 455/344 |

*Primary Examiner*—Bernard Roskoski

*Attorney, Agent, or Firm*—Michael I. Kroll

[57] ABSTRACT

A Vib-A-Wake wristwatch is provided that alerts the wearer by vibrating the entire watchband. Unlike watches that vibrate just the watch body, this provides a quieter and more effective alarm. Two vibrating watchband embodiments are provided. In the first, the watchband is vibrated using electromechanical means, and, in the second, the watchband is vibrated using a flexible piezoelectric crystal embedded in the watchband. A snooze alarm and accessory battery charger are provided.

12 Claims, 2 Drawing Sheets

VIB-A-WAKE

BACKGROUND OF THE INVENTION

The instant invention relates generally to wrist watches and, more specifically, to wrist watches that provide a silent alarm to the wearer.

At the present state of the art, most alarm watches provide an audible signal to alert the wearer that the alarm has sounded. This audible signal can often cause serious problems. For example, when worn in public, the alarm can cause disruption. When worn to bed, the audible alarm can awaken nearby individuals who are trying to sleep. In some instances, the alarm can be so distracting that it endangers public safety and welfare.

A number of inventions have been proposed to address this problem. These include Electricity Supply Structure for a Piezoelectric Vibrator, Tanaka et al. (U.S. Pat. No. 4,821,257); Alarm Signal Bracelet, W. Stanton (U.S. Pat. Des. 279,671); Combined Wristwatch and Container, Jones et al. (U.S. Pat. Des. 296,675); Watch With Sliding Door, T. Givings (U.S. Pat. Des. 296,993); Combined Wristwatch and Calculator, W. Kai (U.S. Pat. Des. 303,503); Watchcase With Cover, H. Dinstman (U.S. Pat. No. 2,636,338); Electronic Alarm Watch, G. Diersbock (U.S. Pat. No. 4,733,804); Wrist Watch With Alarm, Toyama et al. (U.S. Pat. No. 4,321,699); Electronic Alarm Wrist Watch, K. Igarashi (U.S. Pat. No. 4,456,387); Wrist Watch With Memo Case, K. Cho (U.S. Pat. 4,903,250); Quiet Alarm Clock, J. Meister (U.S. Pat. No. 4,920,525); Opening and Closing Structure of Cover Lid of Watch, Hiranuma et al. (U.S. Pat. No. 4,964,093); Wristwatch With Oscillation Alarm, Tsukada et al. (U.S. Pat. No. 5,043,956); Electronic Wrist Watch Having a Sound Producing Unit and an Electrooptic Data Display Unit, Yamada et al. (U.S. Pat. No. 5,050,138); and, Electric Apparatus with Silent Alarm, Kawata et al. (U.S. Pat. No. 5,023,853). While some of these propose a vibrating watch body, none of them provides a vibrating watchband. The vibrating watch body provides limited tactile stimulus and tends to emit more noise than a vibrating watchband.

SUMMARY OF THE INVENTION

It is, therefore, a primary object of the instant invention is to provide a Vib-A-Wake wristwatch that alerts the user that the alarm has gone off by vibrating the entire watchband.

Another object is to provide a Vib-A-Wake wristwatch that vibrates the watchband by using an oscillator driving a magnetic system that causes a metal band embedded in the watchband to vibrate.

A yet further object is to provide a Vib-A-Wake wristwatch that vibrates the watchband by using an oscillator driving a flexible piezoelectric crystal embedded in the watchband.

A still further object is to provide a Vib-A-Wake wristwatch that uses hook and loop pile type fastener material for watchband closure.

Another object is to provide a Vib-A-Wake wristwatch that is equipped with a pop-out snooze button.

A final object is to provide a Vib-A-Wake wristwatch that is easy to use and inexpensive to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

LIST OF COMPONENTS

| DRAWING NUMBER | DESCRIPTION |
|---|---|
| 14 | Watch Display |
| 16 | Date Setting Button |
| 18 | Time Setting Button |
| 20 | Alarm Setting Button |
| 22 | Hinged Button Cover |
| 24 | Snooze Alarm Button |
| 25A, 25B | Hook & Loop Pile Type Fasteners |
| 26 | Oscillator Circuit |
| 28 | Coil |
| 30 | Pole Piece |
| 32A, 32B | Armature |
| 34 | Metal Strip |
| 36 | Oscillator Circuit |
| 38 | Flexible Piezoelectric Crystal |
| 40 | Electromagnet |
| 42 | Latch |
| 44 | Latch Hinge |
| 48 | Coiled Spring |
| 50 | Reset Wire |
| 60 | Battery Charger Accessory |
| 62 | Line Cord |
| 64 | Plug |
| 66 | Charger Base |
| 68 | Watch Mounting Cylinder |
| 70, 72, 74 | Electrical Contacts |

DETAILED DESCRIPTION OF THE PREFERRED EMBODIMENTS

Figure 1:
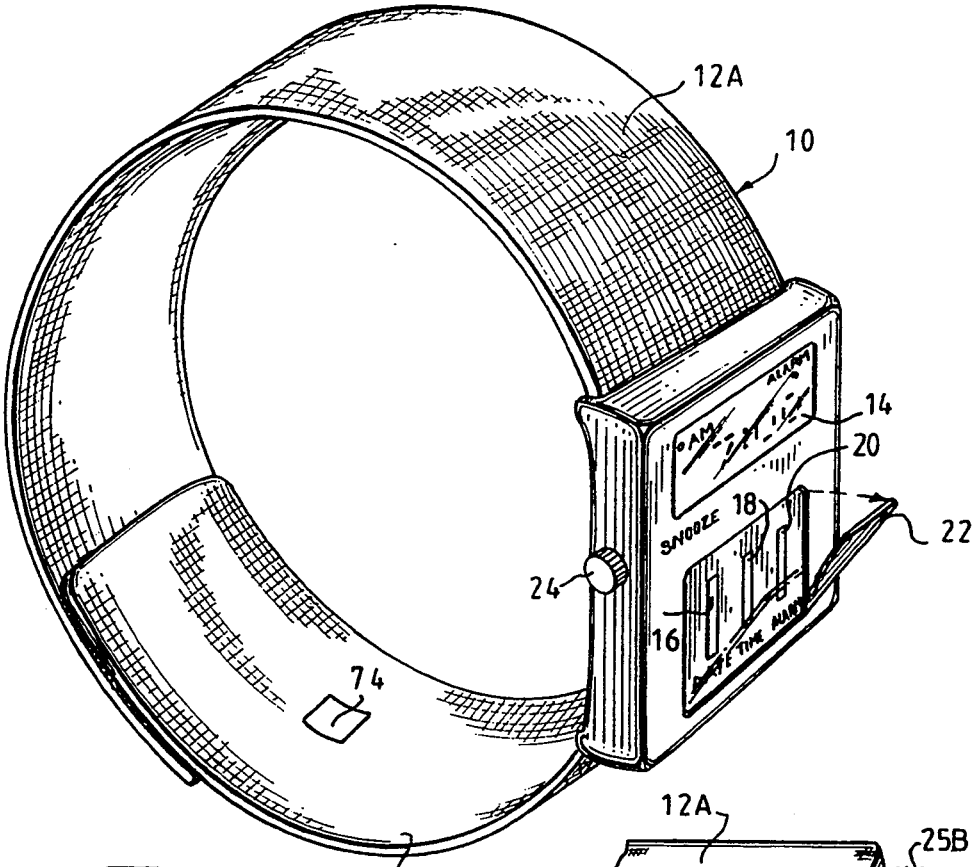
FIG. 1 is a view of the invention shown with protective door hinged outward to reveal the data, time, and alarm buttons.

The general appearance of the invention may best be understood with reference to FIG. 1. Here, the Vib-A-Wake watch 10 is shown with a band 12 that is split into two segments 12A and 12B. The face of the watch has a conventional electronic display 14, and date/time/alarm setting buttons 16, 18, and 20 respectively. In order to prevent inadvertent operation of these buttons, a hinged plated 22 can be closed over the buttons. A snooze alarm button 24 pops out when the alarm is activated and the wearer can push it back in to reset the alarm for some predetermined period of time. The operation of the snooze alarm is detailed below.

Figure 2:
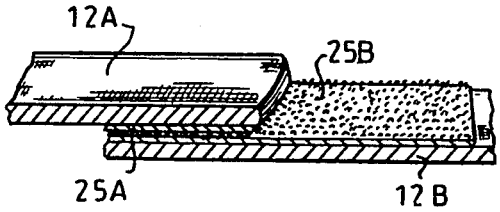
FIG. 2 is a partial cross-sectional view of the wrist strap closure mechanism.

The watchband closure, using hook and loop pile type fastener material is illustrated in FIG. 2. The canvas watchband strips 12A and 12B have strips of hook and loop pile type fastener material, 25A and 25B respectively, permanently affixed.

Figure 3:
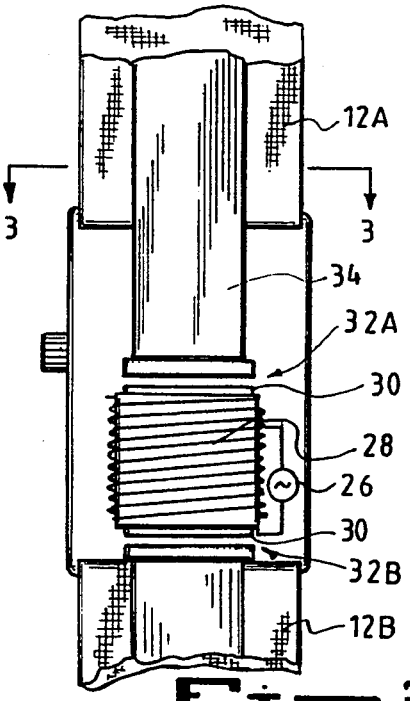
FIG. 3 is a partial internal view of the invention showing an electromagnetic method of causing the wrist strap to vibrate.
Figure 4:
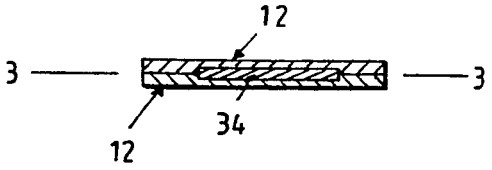
FIG. 4 is a cross-sectional view taken on A—A of FIG. 3 showing the vibrating metal strap embedded in the canvas wrist band.

The watchband 12 can be vibrated using either an electromagnetic or a piezoelectric vibrating means. FIGS. 3 and 4 illustrate the electromagnetic vibrating means. An oscillator 26 is used to provide an AC waveform to coil 28 which is wound around pole piece 30. The alternating magnetic field created in close proximity to the pole pieces causes aerometers 32A and 32B to vibrate. These aerometers are permanently affixed to the ends of metal strap 34 which is embedded in watchband 12. When the alarm activates oscillator 26, metal strip 34 vibrates, as does watchband 12 thereby alerting the wearer.

Figure 5:
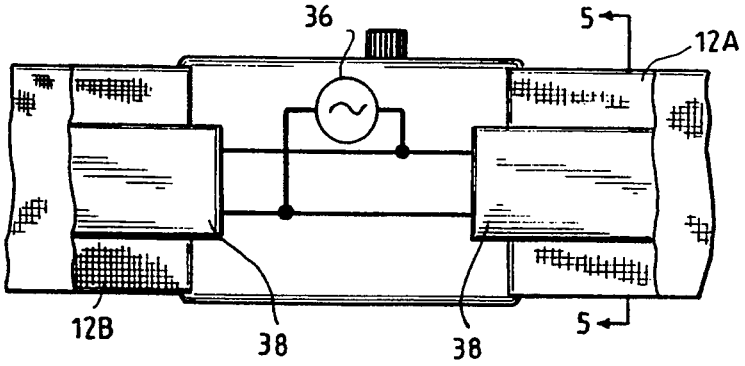
FIG. 5 is a partial internal view of the invention showing an alternative piezoelectric method of causing the wrist strap to vibrate.
Figure 6:
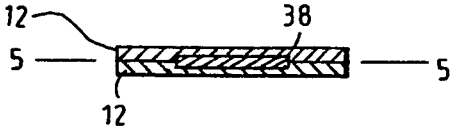
FIG. 6 is a cross-sectional view taken on B—B of FIG. 5 showing the flexible piezo electric crystal embedded in the canvas wrist strap.

FIGS. 4 and 5 illustrate the piezoelectric means of watchband vibration. Here, an oscillator 36 is connected to connected to flexible piezoelectric crystal 38. This type of crystal vibrates mechanically when an AC signal is input. Since the flexible piezoelectric crystal 38 is embedded in watchband 12, the vibration of the crystal 38 causes watchband 12A to vibrate when the alarm activates oscillator 26.

Figure 7:
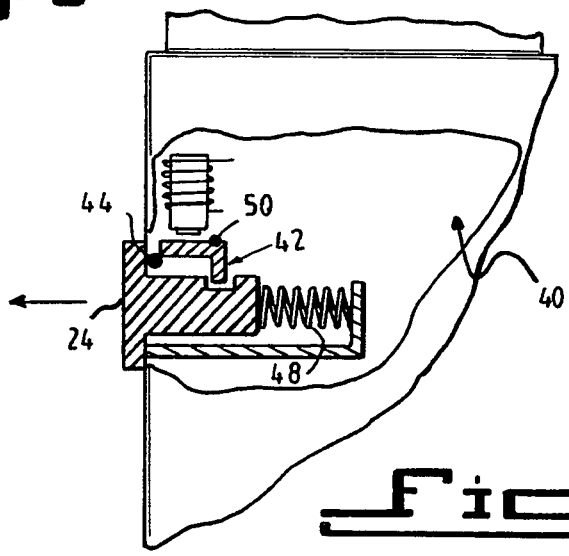
FIG. 7 is an enlarged partial internal view of the invention showing the pop-out snooze button activation mechanism.

The operation of the snooze alarm is best understood with reference to FIG. 7. When the magnetic or piezoelectric vibrating watchband is activated upon the sounding of the alarm, a dc pulse signal is input to the coil of electromagnet 40. This pulls latch 42, which is hinged at 44, towards electromagnet 42. Snooze button 24, which is spring loaded by coil spring 48 then pops out to the left. To reset the alarm for some predetermined period of time, the wearer can push in snooze button 24 which complete the electrical connection to reset wire 50 which causes the alarm circuit to reset.

Figure 8:
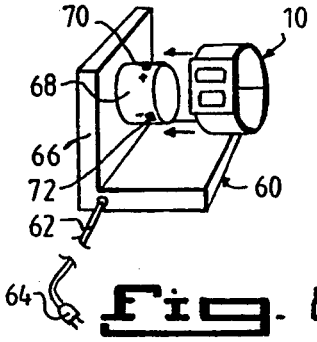
FIG. 8 is a three dimensional view of the charger accessory.

The operation of the battery recharger is best understood with reference to FIG. 8. The charger 60 receives its AC power through line cord 62 and AC plug 64. The charger base 66 contains conventional charging circuits. A watch mounting cylinder 68 has two electrical contacts along is curved surface: positive contact 70 and negative contact 72. The inner surface of the watch has tow corresponding contacts, typified by 74 in FIG. 1. In this figure, only one of the two contacts may be seen.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A Vib-A-Wake comprising in combination:

a) a conventional electric wrist watch with vibrating means functioning to vibrate both watch and wrist band at pre-set alarm times;

b) an energy transmitting watch band functioning to transmit vibrating energy from said watch at preset alarm times through said wrist band to a person's wrist waking up said person; and c) a spring loaded button which returns to its original position after suppression, and functions to extend said pre-set alarm time by a preset snooze time allowing said person to sleep longer before said pre-set alarm is reactivated.

2. A Vib-A-Wake, as recited in claim 1, where said means for vibrating the wrist band of said watch when a preset alarm time coincides with the current time registered on said watch comprises a magnetic wrist band vibrating system.

3. A Vib-A-Wake, as recited in claim 2, further comprising an oscillator; a magnetic coil and a pole piece, whereby said coil is wound around said pole piece wherein said coil is connected to said oscillator thereby creating an oscillating magnetic field; a metal strap embedded in said watchband; two aerometers, each of which is permanently affixed to an end of said metal strap, such that said aerometers are in close proximity to said pole piece, such that said oscillating magnetic field causes said aerometers and said metal band to vibrate at a low frequency, thereby alerting the wearer of said Vib-A-Wake that the alarm has occurred without producing any audible sound.

4. A Vib-A-Wake, as recited in claim 3, wherein said metal band is embedded in a canvas band.

5. A Vib-A-Wake, as recited in claim 1, wherein said watch band is split lengthwise into two strips, the variable closure of which is facilitated using two strips of hook and loop file type fastener material wherein one strip of hook and loop pile type fastener material is permanently affixed to one surface of said split watchband and a second strip of hook and loop pile type fastener material is permanently affixed to the opposing surface of the remaining watchband segment.

6. A Vib-A-Wake, as recited in claim 1, where said means for vibrating the wrist band of said watch when a preset alarm time coincides with the current time registered on said watch comprises a piezoelectric wrist band vibrating system.

7. A Vib-A-Wake, as recited in claim 6, further comprising an oscillator and a flexible piezoelectric crystal embedded in said watchband, wherein said oscillator is connected to said piezoelectric crystal such that said flexible crystal vibrates at a low frequency, thereby alerting the wearer of said Vib-A-Wake that the alarm has occurred without producing any audible sound.

8. A Vib-A-Wake, as recited in claim 7, wherein said flexible piezoelectric crystal is embedded in a canvas band.

9. A Vib-A-Wake, as recited in claim 1, further comprising a hinged cover plate that covers conventional alarm setting buttons such that when said cover is hinged in the closed position, said buttons cannot be activated unintentionally.

10. A Vib-A-Wake, as recited in claim 1, further comprising an electromagnetically operated snooze button.

11. A Vib-A-Wake, as recited in claim 10, wherein said snooze button comprises an electromagnetically operated latch that when activated by the alarm, release a spring loaded button which projects from the body of said Vib-A-Wake, whereby the wearer may reset said button thereby turning off said alarm for some predetermined period of time.

12. A Vib-A-Wake, as recited in claim 1, further comprising a battery charger that recharges a storage battery inside said watch, whereby said watchband is slid over a cylindrical protrusion on said charger and electrical contact between said charger and said watchband is made by placing electrical contacts on the outer surface of said cylinder and on the inner surface of said watchband such that good electrical contact is made.

* * * * *